US008135151B2

(12) United States Patent
Watanabe

(10) Patent No.: US 8,135,151 B2
(45) Date of Patent: Mar. 13, 2012

(54) AUDIO SIGNAL REPRODUCTION DEVICE AND AUDIO SIGNAL REPRODUCTION SYSTEM

(75) Inventor: Atsuo Watanabe, Osaka (JP)

(73) Assignee: Panasonic Corporation, Osaka (JP)

( * ) Notice: Subject to any disclaimer, the term of this patent is extended or adjusted under 35 U.S.C. 154(b) by 301 days.

(21) Appl. No.: 12/664,557

(22) PCT Filed: May 23, 2008

(86) PCT No.: PCT/JP2008/001298

§ 371 (c)(1),
(2), (4) Date: Dec. 14, 2009

(87) PCT Pub. No.: WO2008/155874

PCT Pub. Date: Dec. 24, 2008

(65) Prior Publication Data

US 2010/0183157 A1 Jul. 22, 2010

(30) Foreign Application Priority Data

Jun. 15, 2007 (JP) ..... 2007-159181

(51) Int. Cl.
*H04R 5/02* (2006.01)
*H04R 5/00* (2006.01)

(52) U.S. Cl. ..... 381/307; 381/17; 381/18

(58) Field of Classification Search ..... 381/1, 17–23, 381/80, 81, 307, 119, 123
See application file for complete search history.

(56) References Cited

U.S. PATENT DOCUMENTS 5,870,480 A * 2/1999 Griesinger ..... 381/18
6,760,448 B1 * 7/2004 Gundry ..... 381/23
7,283,634 B2 * 10/2007 Smith ..... 381/20
7,593,533 B2 * 9/2009 Fincham ..... 381/17
2003/0185400 A1 10/2003 Yoshizawa et al.
2005/0281408 A1 * 12/2005 Kim et al. ..... 381/17
2005/0281409 A1 12/2005 Sakane et al.
2006/0045291 A1 * 3/2006 Smith ..... 381/119
2006/0259170 A1 11/2006 Sasaki et al.
2007/0077020 A1 4/2007 Takahama
2007/0133812 A1 6/2007 Yoshizawa et al.
2007/0242832 A1 * 10/2007 Matsumoto et al. ..... 381/2
2008/0063211 A1 * 3/2008 Kusunoki ..... 381/18
2009/0041257 A1 2/2009 Yoshizawa et al.
2010/0324915 A1 * 12/2010 Seo et al. ..... 704/500

FOREIGN PATENT DOCUMENTS

JP 2004-007389 A 1/2004

(Continued)

*Primary Examiner* — Xu Mei

(74) *Attorney, Agent, or Firm* — Hamre, Schumann, Mueller & Larson, P.C.

(57) ABSTRACT

In an audio signal reproduction device and an audio signal reproduction system of the present invention, an SLch sound is reproduced as a mixed sound that is adjusted appropriately by two speakers 5*a*, 5*d* located at Lch and SBLch speaker positions, and an SRch sound is reproduced as a mixed sound that is adjusted appropriately by two speakers 5*b*, 5*e* located at Rch and SBRch speaker positions. This configuration can achieve 5.1ch virtual reproduction with high sound quality in which sounds for 5.1 channels of LPCM 7.1ch audio information included in the contents are output as they are and sounds for the remaining 2 channels are reproduced artificially even if speakers compatible with the 5.1ch sound field system are connected.

4 Claims, 3 Drawing Sheets

FOREIGN PATENT DOCUMENTS

| | | | |
|---|---|---|---|
| JP | 2004-023674 | A | 1/2004 |
| JP | 2004-312484 | | 11/2004 |
| JP | 2005-341208 | A | 12/2005 |
| JP | 2006/005701 | A | 1/2006 |
| JP | 2006-311288 | | 11/2006 |
| JP | 2007-088774 | | 4/2007 |

* cited by examiner

AUDIO SIGNAL REPRODUCTION DEVICE AND AUDIO SIGNAL REPRODUCTION SYSTEM

TECHNICAL FIELD

The present invention relates to an audio signal reproduction device and an audio signal reproduction system that are capable of reproducing multi-channel audio signals. In particular, the present invention relates to a device and a system that are applicable to an acoustic apparatus such as an audio amplifier or a receiver.

BACKGROUND ART

DVDs (digital versatile disks) containing various contents such as movies have been widespread. In recent years, next-generation disks such as BDs (Blue-ray disks) and HD-DVDs (high-definition DVDs) containing various contents are becoming widespread in addition to the DVDs. Moreover, the use of a home theater system to reproduce the contents of the next-generation disks is spreading. The home theater system is, e.g., a 5.1-channel sound field system (hereinafter, the term "channel" is represented by "ch") installed at home. Unlike the DVDs containing audio information provided for the 5.1ch sound field system, the next-generation disks contain uncompressed high-quality audio information provided mainly for a LPCM (linear pulse code modulation) 7.1ch sound field system. For the reproduction of such contents, when an AV amplifier connected to a reproduction apparatus such as a BD player is compatible with the 7.1ch sound field system, a speaker system compatible with the 7.1ch sound field system can be used to perform multi-channel reproduction with precise auditory localization and high sound quality.

FIG. 3 shows the configuration of a conventional audio signal reproduction system compatible with the 5.1ch sound field system.

In FIG. 3, an AV amplifier 110 includes the following: a communication portion 101 that can communicate with external equipment 106 via a cable 107; a control portion 102 that converts the information received by the communication portion 101 into 5.1ch audio information; digital-to-analog converters (referred to as "DAC" in the following) 103*a* to 103*f* that convert the audio information (digital signals) output from the control portion 102 into analog audio signals; amplifiers 104*a* to 104*e* that are connected to the DACs 103*a* to 103*e*, respectively; a central processing unit (CPU) 111 that controls the communication portion 101 and the control portion 102; a ROM (read only memory) 112; and a RAM (random access memory) 113.

The boxes indicated by a broken line in the control portion 102 show the audio information for each channel. In FIG. 3, "Lch" represents the audio information to be output from a left front speaker, "Rch" represents the audio information to be output from a right front speaker, "Cch" represents the audio information to be output from a center speaker, "SLch" represents the audio information to be output from a left rear speaker, "SRch" represents the audio information to be output from a right rear speaker, and "SWch" represents the audio information to be output from a sub-woofer.

The external equipment 106 (e.g., a BD player) and speakers 105*a* to 105*f* compatible with the 5.1ch sound field system are connected to the AV amplifier 110. The speaker 105*f* is connected to the AV amplifier 110 via an amplifier 104*f*. In this case, the speaker 105*f* may contain an amplifier and be connected directly to the AV amplifier 110.

The BD audio information reproduced and output from the external equipment 106 is input in the form of digital data to the communication portion 101 of the AV amplifier 110 via the cable 107. Then, the audio information received by the communication portion 101 is input to the control portion 102 and decoded to 5.1ch audio information. The audio information decoded by the control portion 102 is input to the individual DACs 103*a* to 103*f* for each channel and converted into analog audio signals. The audio signals output from the DACs 103*a* to 103*f* are amplified by the amplifiers 104*a* to 104*f* and output through the speakers 105*a* to 105*f* to the outside as sounds, respectively.

Patent Document 1 discloses down-mixing 7.1ch audio information so that it can be reproduced with the 5.1ch sound field system.

Patent Document 1: JP 2005-341208 A

DISCLOSURE OF INVENTION

Problem to be Solved by the Invention

However, when the 7.1ch audio information is reproduced with a system to which speakers compatible with the 5.1ch sound field system are connected, the sound quality can be reduced.

For example, if the speakers compatible with the 5.1ch sound field system are connected to the AV amplifier compatible with the 5.1ch sound field system or 7.1ch sound field system, the information that "the AV amplifier 110 is compatible with the 5.1ch sound field system" is transmitted to the external equipment 106 by EDID extended display identification data) control information transmission between the external equipment 106 and the AV amplifier 110. Consequently, the external equipment 106 has to down-mix the 7.1ch audio information to 5.1ch audio information (see Patent Document 1) and transmit the 5.1ch audio information to the AV amplifier 110, or has to extract the compressed 5.1ch audio information, which is included along with the 7.1ch audio information in the contents, and transmit it to the AV amplifier 110. In such a configuration, a part of the audio information is missed during the down-mixing process or the compression process, so that the sound quality of sounds provided particularly for the high-quality LPCM 7.1ch sound field system is reduced.

It is an object of the present invention to achieve 5.1ch virtual reproduction with high sound quality in which sounds for 5.1 channels of LPCM 7.1ch audio information included in the contents are output as they are and sounds for the remaining 2 channels are reproduced artificially even if speakers compatible with the 5.1ch sound field system are connected.

Means for Solving Problem

An audio signal reproduction device of the present invention can be connected to a speaker system capable of outputting audio signals of a 5.1-channel sound field system and external equipment. The speaker system includes the following: a center speaker that is located at the front center of a listening position and capable of outputting a C-channel sound; a left front speaker and a right front speaker that are located on both sides of the center speaker and capable of outputting an L-channel sound and a R-channel sound, respectively; and a left rear speaker and a right rear speaker that are located on both sides of the listening position and capable of outputting an SL-channel sound and an SR-channel sound, respectively. The external equipment outputs audio information provided for a 7.1-channel sound field system in which SBL-channel audio information and SBR-channel audio information to be output from a left back speaker and a right back speaker that are located at the back of the listening position and arranged side by side are added to audio information provided for the 5.1-channel sound field system. The audio signal reproduction device includes a control portion for producing audio information provided for the 5.1-channel sound field system based on the audio information provided for the 7.1-channel sound field system that is transmitted from the external equipment. The control portion produces audio information to be output from the left front speaker by mixing L-channel audio information and SL-channel audio information that are transmitted from the external equipment. The control portion produces audio information to be output from the right front speaker by mixing R-channel audio information and SR-channel audio information that are transmitted from the external equipment. The control portion produces audio information to be output from the left rear speaker by mixing SBL-channel audio information and SL-channel audio information that are transmitted from the external equipment. The control portion produces audio information to be output from the right rear speaker by mixing SBR-channel audio information and SR-channel audio information that are transmitted from the external equipment.

An audio signal reproduction system of the present invention includes a speaker system capable of outputting audio signals of a 5.1-channel sound field system and an audio signal reproduction device that can be connected to external equipment. The speaker system includes the following: a center speaker that is located at the front center of a listening position and capable of outputting a C-channel sound; a left front speaker and a right front speaker that are located on both sides of the center speaker and capable of outputting an L-channel sound and a R-channel sound, respectively; and a left rear speaker and a right rear speaker that are located on both sides of the listening position and capable of outputting an SL-channel sound and an SR-channel sound, respectively. The external equipment outputs audio information provided for a 7.1-channel sound field system in which SBL-channel audio information and SBR-channel audio information to be output from a left back speaker and a right back speaker that are located at the back of the listening position and arranged side by side are added to audio information provided for the 5.1-channel sound field system. The audio signal reproduction device includes a control portion for producing audio information provided for the 5.1-channel sound field system based on the audio information provided for the 7.1-channel sound field system that is transmitted from the external equipment. The control portion produces audio information to be output from the left front speaker by mixing L-channel audio information and SL-channel audio information that are transmitted from the external equipment. The control portion produces audio information to be output from the right front speaker by mixing R-channel audio information and SR-channel audio information that are transmitted from the external equipment. The control portion produces audio information to be output from the left rear speaker by mixing SBL-channel audio information and SL-channel audio information that are transmitted from the external equipment. The control portion produces audio information to be output from the right rear speaker by mixing SBR-channel audio information and SR-channel audio information that are transmitted from the external equipment.

Effects of the Invention

According to the present invention, in a system to which speakers compatible with the 5.1ch sound field system are connected, a part of the LPCM 7.1ch audio information included in the contents can be reproduced and output artificially. Therefore, the present invention has the advantage of being able to reproduce and output sounds based on the high-quality LPCM 7.1ch audio information with a simple speaker system compatible with the 5.1ch sound field system.

DESCRIPTION OF THE INVENTION

Figure 1:
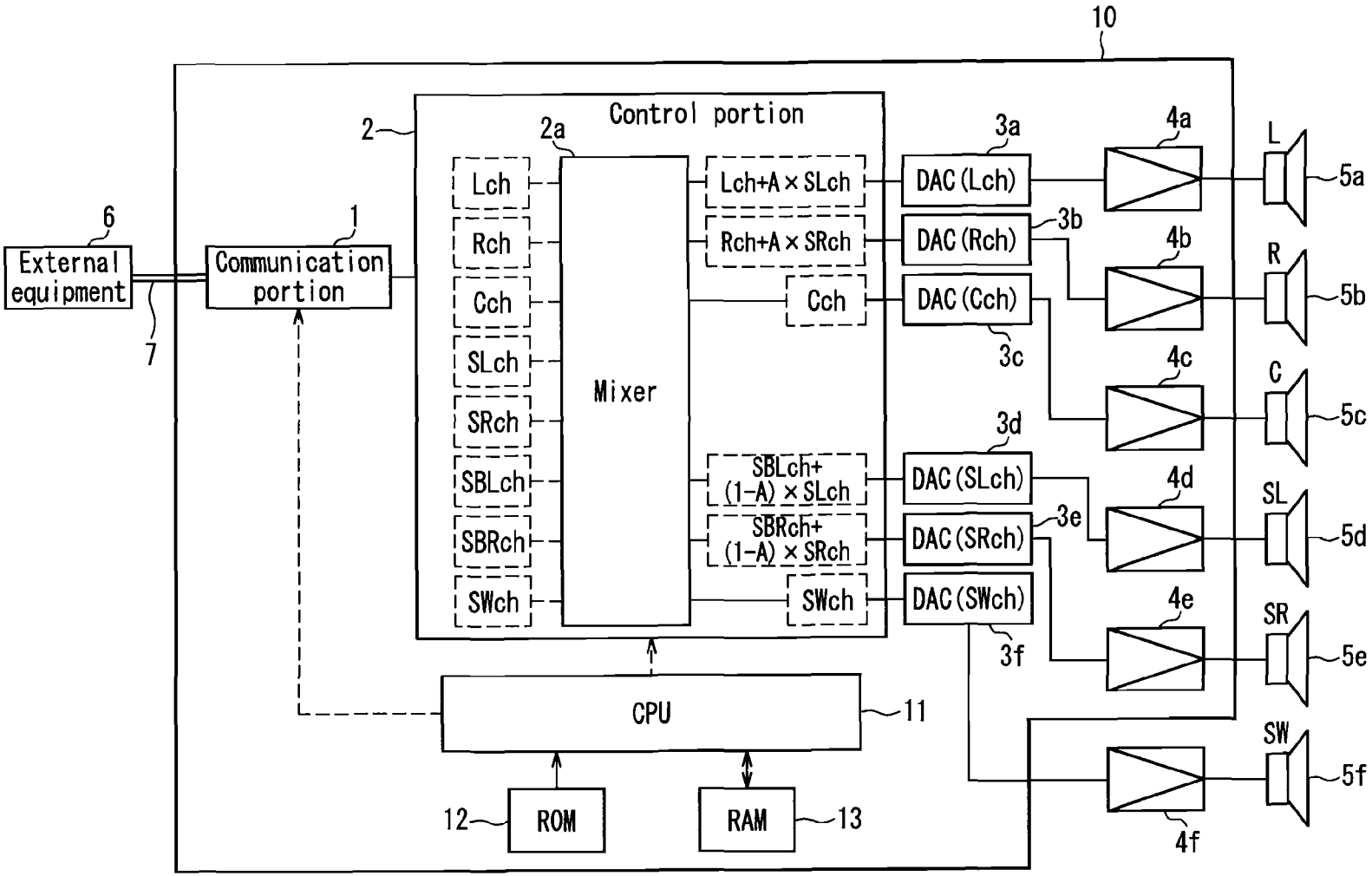
FIG. 1 is a block diagram showing the configuration of an audio signal reproduction system of an embodiment.

The audio signal reproduction device and the audio signal reproduction system of the present invention can have the following aspects on the basis of the above configurations.

In the audio signal reproduction device and the audio signal reproduction system of the present invention, the control portion may add the SL-channel audio information to each of the L-channel audio information and the SBL-channel audio information at a predetermined ratio, and add the SR-channel audio information to each of the R-channel audio information and the SBR-channel audio information at a predetermined ratio. With this configuration, an audio image of the SL-channel audio information can be formed between the left front speaker and the left rear speaker, and thus a speaker can be added artificially. At the same time, an audio image of the SR-channel audio information can be formed between the right front speaker and the right rear speaker, and thus another speaker can be added artificially. Consequently, high-quality 7.1-channel sounds can be reproduced artificially by the 5.1-channel sound field system.

In the audio signal reproduction device and the audio signal reproduction system of the present invention, the control portion may vary the predetermined ratio. With this configuration, the audio image formed between the left front speaker and the left rear speaker and the audio image formed between the right front speaker and the right rear speaker can be adjusted to any positions.

Embodiments

The audio signal reproduction device and the audio signal reproduction system of the present invention have a configuration to control the external equipment using EDID of a HDMI control signal system so that when the speakers compatible with the 5.1ch sound field system are connected to the AV amplifier, and the contents include LPCM 7.1ch audio information, the external equipment transmits the 7.1ch audio information to the AV amplifier as it is. In other words, the audio signal reproduction device and the audio signal reproduction system of the present invention do not down-mix the 7.1ch audio information to 5.1ch audio information even if the 7.1ch audio information is included in the contents to be reproduced.

The audio signal reproduction device and the audio signal reproduction system of the present invention include the speakers compatible with the 5.1ch sound field system. Among these speakers, an SLch speaker and an SRch speaker are located at the positions of an SBLch speaker and an SBRch speaker that have been recommended intrinsically for the 7.1ch speaker arrangement, respectively. With this configuration, the 7.1ch audio signals are input to the speakers compatible with the 5.1ch sound field system and reproduced artificially.

In the above configuration, an SLch sound is produced by mixing the sound output from the speaker located at the Lch speaker position and the sound output from the speaker located at the SBLch speaker position. Moreover, an SRch sound is produced by mixing the sound output from the speaker located at the Rch speaker position and the sound output from the speaker located at the SBRch speaker position. In other words, among the 7.1ch audio information (Lch, Rch, Cch, SLch, SRch, SBLch, SBRch, and SWch) output from the external equipment, sounds based on the audio information of Lch, Rch, Cch, SBLch, SBRch, and SWch are reproduced as original sounds from their respective specified speakers and only sounds based on the SLch audio information and the SRch audio information are reproduced artificially using other speakers.

As described above, the present invention not only requires the external equipment connected to the AV amplifier to transmit the 7.1ch audio information, but also controls the speakers that are compatible with the 5.1ch sound field system and connected to the AV amplifier to reproduce and output sounds artificially based on the 7.1ch audio information transmitted from the external equipment in response to the requirement.

Hereinafter, embodiments of the audio signal reproduction device and the audio signal reproduction system of the present invention will be described.

FIG. 1 is a block diagram showing the configuration of the audio signal reproduction system of an embodiment. In FIG. 1, an AV amplifier 10 includes a communication portion 1, a control portion 2, DACs 3*a* to 3*f*, amplifiers 4*a* to 4*e*, a CPU 11, a ROM 12, and a RAM 13. The AV amplifier 10 has a terminal to which external equipment 6 can be connected via a cable 7. The AV amplifier 10 also has terminals to which speakers 5*a* to 5*f* compatible with the 5.1ch sound field system can be connected. The speaker 5*f* is connected to the AV amplifier 10 via an amplifier 4*f*. In this case, the speaker 5*f* may contain an amplifier and be connected directly to the AV amplifier 10. The AV amplifier 10 is an example of the audio signal reproduction device.

The communication portion 1 is a means capable of communicating with the external equipment 6 via the cable 7. In this embodiment, the amplifier 10 and the external equipment 6 communicate based on a method that is compliant with the HDMI (high-definition multimedia interface) standard. The communication portion 1 has a HDMI port to which a HDMI cable can be connected. The communication between the AV amplifier 10 and the external equipment 6 is not limited to the method based on the HDMI standard, and other communication systems may be used as long as at least data including the 7.1ch audio information can be transmitted from the external equipment 6.

The control portion 2 extracts the 7.1ch audio information from the data received by the communication portion 1. The control portion 2 includes a mixer 2*a*. The mixer 2*a* mixes the 7.1ch audio information at a predetermined ratio to produce audio information that can be output from the speakers compatible with the 5.1ch sound field system. A specific mixing method will be described later. The boxes indicated by a broken line in the control portion 2 show the audio information for each channel. The 7.1ch audio information input to the control portion 2 includes the following: Lch audio information (audio information to be output from a left front speaker); Rch audio information (audio information to be output from a right front speaker); Cch audio information (audio information to be output from a center speaker); SLch audio information (audio information to be output from a left rear speaker); SRch audio information (audio information to be output from a right rear speaker); SBLch audio information (audio information to be output from a left back speaker); SBRch audio information (audio information to be output from a right back speaker); and SWch audio information (audio information to be output from a sub-woofer).

The DACs 3*a* to 3*f* convert the audio information (digital signals) output from the control portion 2 into analog audio signals. In the control portion 2, since 5.1ch audio information is produced based on the 7.1ch audio information, the DACs are six in total. The DAC 3*a* converts the Lch audio information into analog audio signals. The DAC 3*b* converts the Rch audio information into analog audio signals. The DAC 3*c* converts the Cch audio information into analog audio signals. The DAC 3*d* converts the SLch audio information into analog audio signals. The DAC 3*e* converts the SRch audio information into analog audio signals. The DAC 3*f* converts the SWch audio information into analog audio signals.

The amplifiers 4*a* to 4*f* amplify the audio signals output from the DACs 3*a* to 3*f*, respectively. In this configuration, the sub-woofer amplifier 4*f* is mounted in the sub-woofer unit rather than the AV amplifier 10.

The speakers 5*a* to 5*f* can be connected to speaker connection terminals provided in the AV amplifier 10 and are compatible with the 5.1ch sound field system. Specifically, the center speaker 5*c* (Cch speaker) is located in front of a listener, the left front speaker 5*a* (Lch speaker) and the right front speaker 5*b* (Rch speaker) are located on both sides of the center speaker 5*c*, and the left rear speaker 5*d* (SLch speaker) and the right rear speaker 5*e* (SRch speaker) are located at the back of the listener and arranged side by side. In this embodiment, the speakers 5*d* and 5*e* that should be located on both sides of the listener in the general 5.1ch sound field system are located where the SBLch speaker and the SBRch speaker are to be located in the 7.1ch sound field system.

The external equipment 6 can be connected to the communication portion 1 of the AV amplifier 10 via the cable 7. In this embodiment, a BD player capable of reproducing the BD contents including the 7.1ch audio information is used as an example of the external equipment 6. The external equipment 6 may be any equipment as long as it at least can output data including the 7.1ch audio information. In this embodiment, the external equipment 6 and the AV amplifier 10 communicate based on the HDMI standard. However, the communications standard is not limited to the HDMI standard, and the external equipment 6 may have any configuration as long as at least it can communicate data including the audio information, the control information, etc. with the AV amplifier 10.

The CPU 11 controls the EDID control of the communication portion 1 and the internal processing operations of the control portion 2. Moreover, the CPU 11 can rewrite the EDID signals in accordance with the selection information transmitted through the communication portion 1. The ROM 12 and the RAM 13 are connected to the CPU 11. The ROM 12 stores the operating program of the CPU 11, and the RAM 13 temporarily stores a work file while the CPU 11 performs various processing operations.

Hereinafter, operations will be described.

First, the EDID signals are communicated between a communication portion in the external equipment 6 and the communication portion 1 in the AV amplifier 10 via the cable 7 to exchange information about the contents of a BD that can be reproduced by the AV amplifier 10. For example, the specification of audio information included in the contents and the specification of audio information that can be reproduced by the AV amplifier 10 are exchanged. As a result of the information exchange between the external equipment 6 and the AV amplifier 10, if the contents include 7.1ch audio information, and the AV amplifier 10 is certified as compatible with the 7.1ch audio information, then the external equipment 6 can output data including the 7.1ch audio information to the AV amplifier 10. Since the AV amplifier 10 of this embodiment is compatible with the 7.1ch audio information, information about the compatibility of the AV amplifier 10 is transmitted to the external equipment 6 by the EDID signals.

Figure 3:
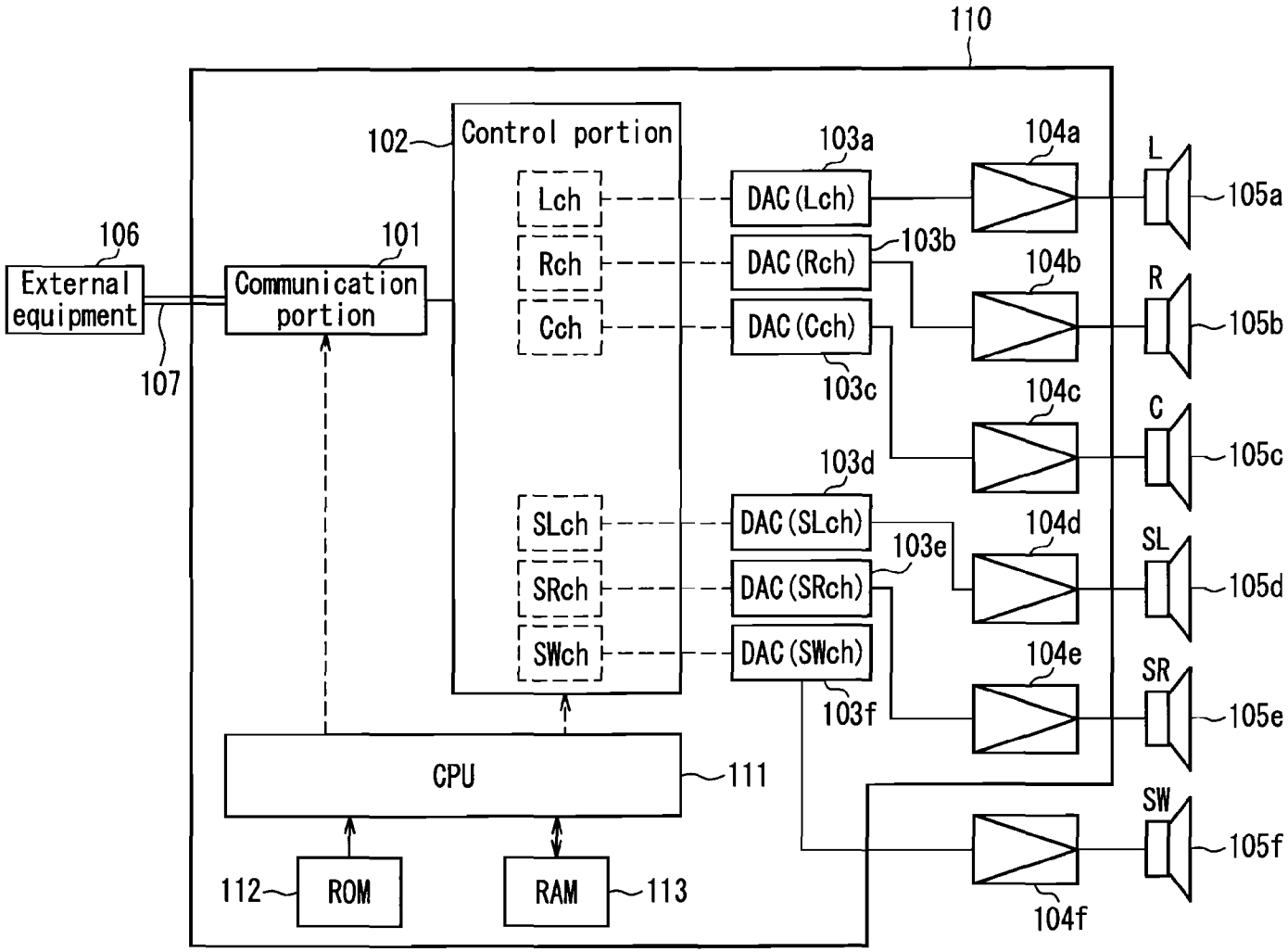
FIG. 3 is a block diagram showing the configuration of a conventional audio signal reproduction system.

If a system includes an AV amplifier that is not compatible with the 7.1ch audio information, as in the case of the conventional technology shown in FIG. 3, the external equipment down-mixes the 7.1ch audio information to 5.1ch audio information, which is a signal format that can be reproduced by the AV amplifier, and transmits the 5.1ch audio information to the communication portion of the AV amplifier. In this embodiment, however, since the AV amplifier 10 is compatible with the 7.1ch audio information, the CPU 11 performs EDID control on the communication portion 1. Due to the control of the CPU 11, the communication portion 1 instructs the external equipment 6 to transmit data including the 7.1ch audio information. Subsequently, the external equipment 6 transmits the data including the 7.1ch audio information to the AV amplifier 10 via the cable 7 based on the instruction of the communication portion 1.

The communication portion 1 transmits the data output from the external equipment 6 to the control portion 2. The control portion 2 extracts the 7.1ch audio information, i.e., the Lch audio information, the Rch audio information, the Cch audio information, the SLch audio information, the SRch audio information, the SBLch audio information, the SBRch audio information, and the SWch audio information from the input data and decodes the extracted audio information. The eight pieces of audio information thus decoded are input to the mixer 2*a* in the control portion 2. The mixer 2*a* mixes the eight pieces of audio information to produce six pieces of audio information (i.e., Lch2 audio information, Rch2 audio information, Cch2 audio information, SBLch2 audio information, SBRch2 audio information, and SWch2 audio information) to be output from the speakers compatible with the 5.1ch sound field system. The mixing operation of the mixer 2*a* is performed based on the following formulas.

$$Lch \rightarrow Lch2 = Lch + A \times SLch$$

$$Rch \rightarrow Rch2 = Rch + A \times SRch$$

$$Cch \rightarrow Cch2 = Cch \text{ (unprocessed)}$$

$$SLch \rightarrow \text{no output}$$

$$SRch \rightarrow \text{no output}$$

$$SBLch \rightarrow SBLch2 = SBLch + (1-A) \times SLch$$

$$SBRch \rightarrow SBRch2 = SBRch + (1-A) \times SRch$$

$$SWch \rightarrow SWch2 = SWch \text{ (unprocessed)}$$

where a mixing coefficient $A$ satisfies $0<A<1$.

Thereafter, the Lch2 audio information is input to the DAC 3*a* and converted into analog audio signals. The Rch2 audio information is input to the DAC 3*b* and converted into analog audio signals. The Cch2 audio information is input to the DAC 3*c* and converted into analog audio signals. The SBLch2 audio information is input to the DAC 3*d* and converted into analog audio signals. The SBRch2 audio information is input to the DAC 3*e* and converted into analog audio signals. The SWch2 audio information is input to the DAC 3*f* and converted into analog audio signals.

Next, the audio signals output from the DACs 3*a* to 3*f* are amplified by the amplifiers 4*a* to 4*f* and input to the speakers 5*a* to 5*f*, respectively. Thus, sounds based on the audio signals are reproduced and output from each of the speakers 5*a* to 5*f*.

Next, a speaker arrangement for effective reproduction of the audio signals will be described with reference to FIG. 2.

Figure 2:
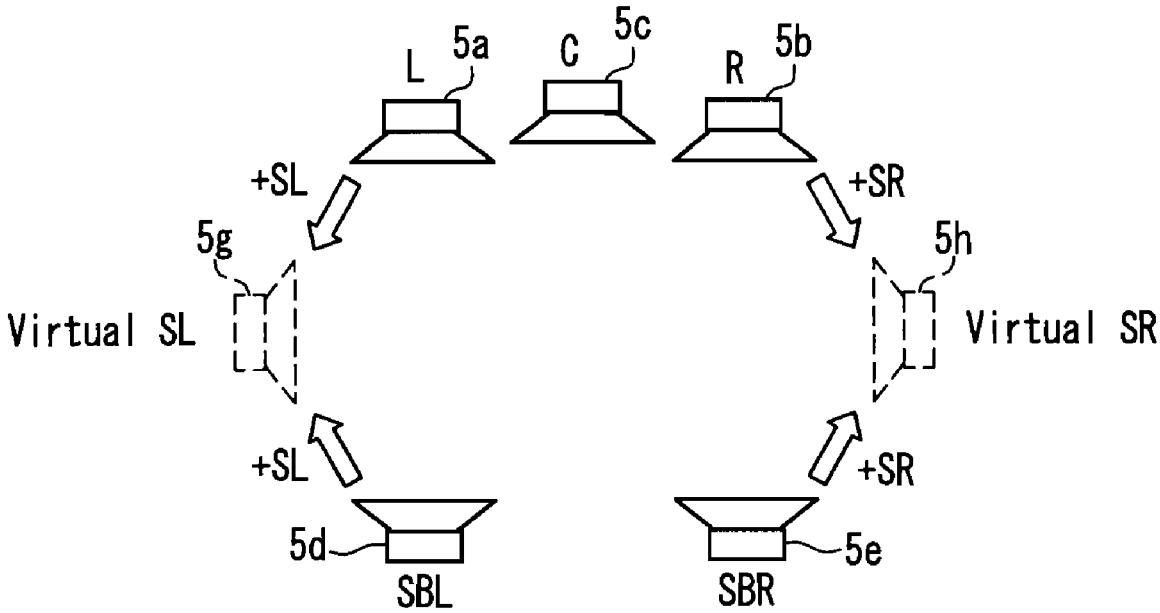
FIG. 2 is a schematic diagram showing a positional relationship among speakers connected to an audio signal reproduction system of an embodiment.

FIG. 2 is a schematic diagram showing a speaker arrangement of this embodiment. In FIG. 2, six speakers compatible with the 5.1ch sound field system are located so as to be compatible with the 7.1ch sound field system. For convenience of explanation, the sub-woofer speaker 5*f* is omitted from FIG. 2. In the system of FIG. 2, the locations of three front speakers 5*a*, 5*b*, and 5*c* are the same as those in the general 5.1ch sound field system, while the locations of two rear speakers 5*d* and 5*e* are the same as those of surround back speakers in the 7.1ch sound field system.

A multi-channel reproduction system such as the 5.1ch sound field system generally employs the speaker arrangement defined by ITU-R recommendation. In the audio signal reproduction system (5.1ch virtual reproduction system) of this embodiment, as shown in FIG. 2, the rear speakers 5*d* and 5*e* are located at the positions (indicated by SBL and SBR in FIG. 2) of the surround back speakers of the speaker arrangement for the 7.1ch sound field system defined by ITU-R recommendation. With this arrangement, sounds based on the 7.1ch audio information other than the SLch audio information and the SRch audio information can be reproduced properly by the six speakers that are located in accordance with the speaker arrangement for the 7.1ch sound field system defined by ITU-R recommendation.

The SLch audio information is processed by the mixer 2*a* in the control portion 2, so that the Lch2 audio information and the SBLch2 audio information are produced. Accordingly, the Lch speaker 5*a* outputs sounds based on the audio information that is A times (A is a mixing coefficient) as much as the SLch audio information. Moreover, the SLch speaker 5*d* located at the position of the SBLch speaker outputs sounds based on the audio information that is (1−A) times as much as the SLch audio information. Therefore, when the mixing coefficient A is set to an appropriate value, the sounds are mixed to form an audio image between the Lch speaker 5*a* and the SLch speaker 5*d*. Thus, sounds can be output from a virtual speaker 5*g*.

Similarly, the SRch audio information is processed by the mixer 2*a* in the control portion 2, so that the Rch2 audio information and the SBRch2 audio information are produced. Accordingly, the Rch speaker 5*b* outputs sounds based on the audio information that is A times as much as the SRch audio information. Moreover, the SRch speaker 5*e* located at the position of the SBRch speaker outputs sounds based on the audio information that is (1−A) times as much as the SRch audio information. Therefore, when the mixing coefficient A is set to an appropriate value, the sounds are mixed to form an audio image between the Rch speaker 5*b* and the SRch speaker 5*e*. Thus, sounds can be output from a virtual speaker 5*h*.

As described above, the mixing coefficient A can be set in the range of 0<A<1. If the value of the mixing coefficient A is increased, the audio image of the SLch sound is moved toward the Lch speaker 5*a* (i.e., the position of the virtual speaker 5*g* is shifted toward the Lch speaker 5*a*) and the audio image of the SRch sound is moved toward the Rch speaker 5*b* (i.e., the position of the virtual speaker 5*h* is shifted toward the Rch speaker 5*b*). If the value of the mixing coefficient A is reduced, the audio image of the SLch sound is moved toward the SLch speaker 5*d* and the audio image of the SRch sound is moved toward the SRch speaker 5*e*. Therefore, the audio image of the SLch sound and the audio image of the SRch sound can be formed at any positions by setting the mixing coefficient A to a desired value.

The mixing coefficient A may be adjusted in the following manner. For example, a switch for adjusting the audio image is mounted on a remote control that allows the AV amplifier 10 to be controlled from a distance, and the value of the mixing coefficient A is increased or reduced in the control portion 2 by operating the switch. A user can operate the switch so that the virtual speakers 5*g* and 5*h* are located at any desired positions. It is desirable that the positions of the virtual speakers 5*g* and 5*h* are adjusted to optimum positions in view of the size of a space in which the system is installed or the listening position.

As described above, in the present invention, the audio signals provided for the high-quality LPCM 7.1ch sound field system can be reproduced artificially with a low-cost AV amplifier compatible with the 5.1ch sound field system by adding simple HDMI control and an operating program and changing a part of the speaker arrangement. This can improve the sound quality when the contents including the 7.1ch audio information are reproduced.

In the conventional technology, when the contents provided for the 7.1ch sound field system are reproduced, a part of the 7.1ch audio information is missed due to down mixing or compression, and the sound quality is reduced. To address this problem, this embodiment produces 5.1ch audio information and virtual 2ch audio information based on the 7.1ch audio information transmitted from the external equipment 6. Consequently, high-quality audio signals can be reproduced in the 5.1ch sound field system without missing the 7.1ch audio information.

Moreover, this embodiment can adjust the mixing coefficient A to a desired value, thereby adjusting the positions of the virtual speakers 5*g* and 5*h* to any positions. Thus, an optimum acoustic environment can be provided in accordance with the size of a space in which the system is installed or the position of a listener.

Using such simple mixing as a basic operation, an inverse addition further may be added appropriately to correct the effect.

In this embodiment, the mixing coefficient A can be set to a desired value in the range of $0<A<1$. However, the mixing coefficient A may be fixed to a desired value beforehand. If the mixing coefficient A is a fixed value, the manufacturer of the AV amplifier 10 may set it to a predetermined value, or the user may set it to a predetermined value during the initialization of the AV amplifier 10. By setting the mixing coefficient A to a fixed value, it is possible to eliminate a difficult setting operation by the user.

In the above description, the speaker system compatible with the 5.1ch sound field system is connected to the AV amplifier 10 to reproduce the contents provided for the 7.1ch sound field system. When this speaker system is used to reproduce the contents provided for the 5.1ch sound field system, the sounds based on the audio information can be output through each of the speakers without performing the mixing operation of the mixer 2*a*.

INDUSTRIAL APPLICABILITY

The audio signal reproduction device and the audio signal reproduction system of the present invention are applicable to improve the sound quality of an acoustic apparatus such as an AV amplifier or a receiver that can perform multi-channel reproduction and 2-channel stereo reproduction.

The invention claimed is:

1. An audio signal reproduction device that can be connected to a speaker system capable of outputting audio signals of a 5.1-channel sound field system and external equipment, the speaker system comprising:

a center speaker that is located at a front center of a listening position and capable of outputting a C-channel sound;

a left front speaker and a right front speaker that are located on both sides of the center speaker and capable of outputting an L-channel sound and a R-channel sound, respectively; and a left rear speaker and a right rear speaker that are located on both sides of the listening position and capable of outputting an SL-channel sound and an SR-channel sound, respectively, the external equipment outputting audio information provided for a 7.1-channel sound field system in which SBL-channel audio information and SBR-channel audio information to be output from a left back speaker and a right back speaker that are located at a back of the listening position and arranged side by side are added to audio information provided for the 5.1-channel sound field system, the audio signal reproduction device comprising:

a communication portion that instructs the external equipment to transmit the audio information provided for the 7.1-channel sound field system and outputs the audio information provided for the 7.1-channel sound field system transmitted from the external equipment; and a control portion that produces audio information provided for the 5.1-channel sound field system based on the audio information provided for the 7.1-channel sound field system that is output from the communication portion, wherein the control portion produces audio information to be output from the left front speaker by mixing L-channel audio information and SL-channel audio information that are output from the communication portion, the control portion produces audio information to be output from the right front speaker by mixing R-channel audio information and SR-channel audio information that are output from the communication portion, the control portion produces audio information to be output from the left rear speaker by mixing SBL-channel audio information and SL-channel audio information that are output from the communication portion, and the control portion produces audio information to be output from the right rear speaker by mixing SBR-channel audio information and SR-channel audio information that are output from the communication portion.

2. The audio signal reproduction device according to claim 1, wherein the control portion adds the SL-channel audio information to each of the L-channel audio information and the SBL-channel audio information at a predetermined ratio, and adds the SR-channel audio information to each of the R-channel audio information and the SBR-channel audio information at a predetermined ratio.

3. The audio signal reproduction device according to claim 2, wherein the control portion can vary the predetermined ratio.

4. An audio signal reproduction system comprising a speaker system capable of outputting audio signals of a 5.1-channel sound field system and an audio signal reproduction device that can be connected to external equipment, the speaker system comprising:

a center speaker that is located at a front center of a listening position and capable of outputting a C-channel sound;

a left front speaker and a right front speaker that are located on both sides of the center speaker and capable of outputting an L-channel sound and a R-channel sound, respectively; and a left rear speaker and a right rear speaker that are located on both sides of the listening position and capable of outputting an SL-channel sound and an SR-channel sound, respectively, the external equipment outputting audio information provided for a 7.1-channel sound field system in which SBL-channel audio information and SBR-channel audio information to be output from a left back speaker and a right back speaker that are located at a back of the listening position and arranged side by side are added to audio information provided for the 5.1-channel sound field system, the audio signal reproduction device comprising:

a communication portion that instructs the external equipment to transmit the audio information provided for the 7.1-channel sound field system and outputs the audio information provided for the 7.1-channel sound field system transmitted from the external equipment; and a control portion that produces audio information provided for the 5.1-channel sound field system based on the audio information provided for the 7.1-channel sound field system that is output from the communication portion, wherein the control portion produces audio information to be output from the left front speaker by mixing L-channel audio information and SL-channel audio information that are output from the communication portion, the control portion produces audio information to be output from the right front speaker by mixing R-channel audio information and SR-channel audio information that are output from the communication portion, the control portion produces audio information to be output from the left rear speaker by mixing SBL-channel audio information and SL-channel audio information that are output from the communication portion, and the control portion produces audio information to be output from the right rear speaker by mixing SBR-channel audio information and SR-channel audio information that are output from the communication portion.

* * * * *